United States Patent [19]

Laviolette et al.

[11] Patent Number: 4,827,847

[45] Date of Patent: May 9, 1989

[54] SHORT RANGE TUBULAR PROJECTILE

[75] Inventors: Maurice A. Laviolette, Orleans; John R. Evans, Cap Rouge; Brian Cheers, Ste-Foy, all of Canada

[73] Assignee: Her Majesty the Queen in right of Canada, Canada

[21] Appl. No.: 75,731

[22] Filed: Jul. 20, 1987

Related U.S. Application Data

[63] Continuation-in-part of Ser. No. 739,164, May 30, 1985, abandoned.

[51] Int. Cl.[4] ..... F42B 11/00

[52] U.S. Cl. ..... 102/503; 102/501

[58] Field of Search ..... 102/503, 501

[56] References Cited

U.S. PATENT DOCUMENTS

| | | | |
|---|---|---|---|
| 1,278,786 | 9/1918 | Teleszky | 102/503 |
| 4,164,904 | 8/1979 | Laviolette | 102/503 |
| 4,301,736 | 11/1981 | Flatau | 102/503 |

*Primary Examiner*—Donald P. Walsh

*Attorney, Agent, or Firm*—Stevens, Davis, Miller & Mosher

[57] ABSTRACT

A spinning tubular projectile (STUP) is subcaliber to reduce both retard and the gyroscopic stability. The total effect is to reduce crosswind sensitivity and to obtain a better ballistic match with an armor piercing fin stabilized, discarding sabot (APFSDS) round. To reduce the range to that desired for a limited range practice round, the STUP is equipped with spin-damping fins on its surface near the projectile center of gravity.

6 Claims, 5 Drawing Sheets

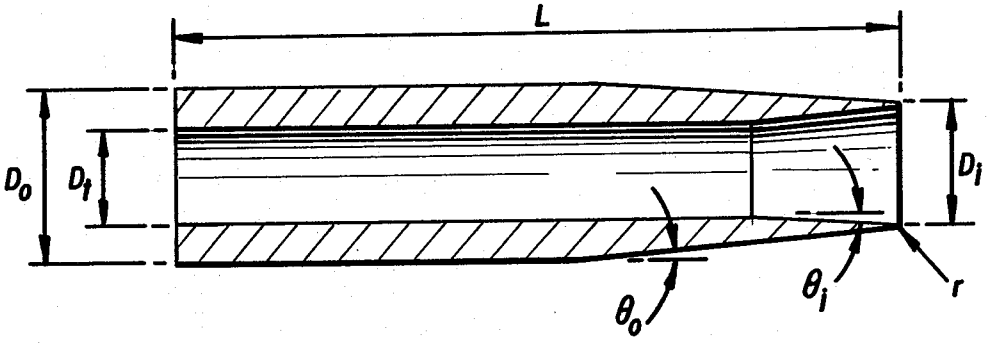
FIG. 3
FIG. 11
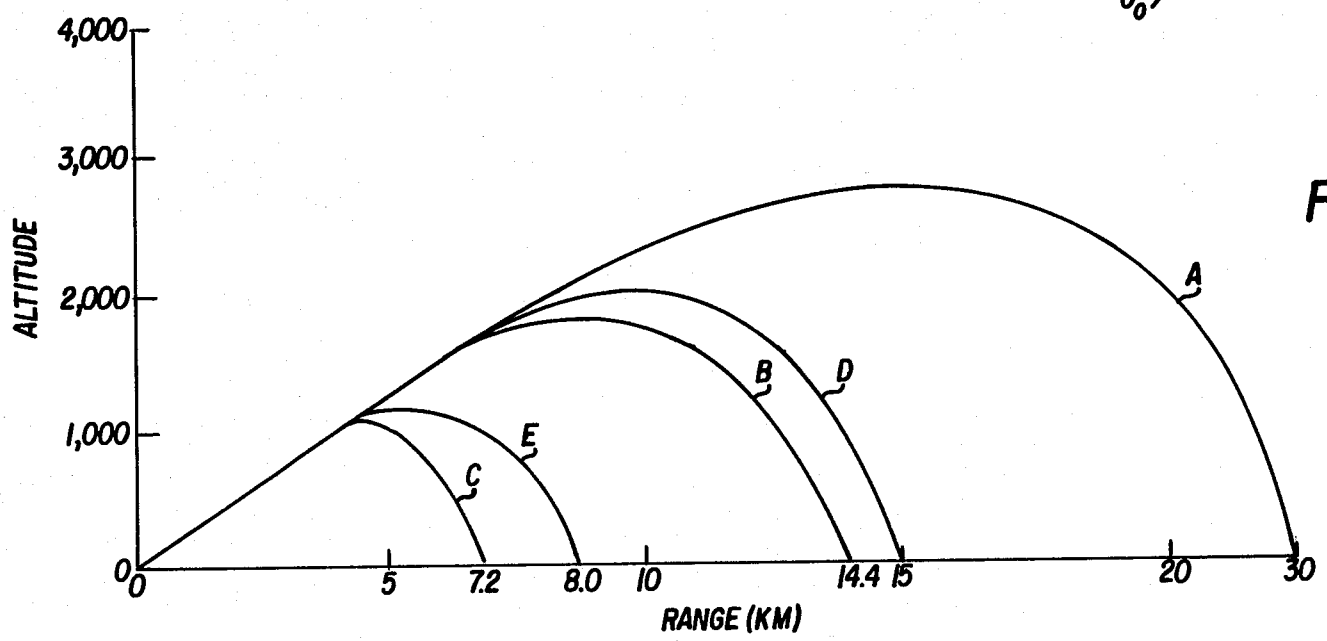

TPDS C-74

STUP MODEL 59
WITHOUT FINS

STUP MODEL 59
WITH FINS

TPDS C-74

STUP MODEL 59
WITHOUT FINS

STUP MODEL 59
WITH FINS

SHORT RANGE TUBULAR PROJECTILE

This application is a continuation-in-part of application 739,164, filed May 30, 1985 for a "Short Range Tubular Projectile".

FIELD OF THE INVENTION

The present invention relates to practice projectiles of limited range and more particularly to such a projectile with a good trajectory match to a low retard combat projectile such as the armour piercing, fin stabilized, discarding sabot (APFSDS) round.

BACKGROUND

It has previously been proposed in Laviolette U.S. Pat. No. 4,164,904, the disclosure of which is incorporated hereinby reference, to provide a limited range practice projectile in the form of a spinning tubular projectile (STUP). This prior proposal is a. spin stabilized, open ended tube with an internal wedge at the leading end. The area ratio, that is the ratio of the smallest open area in the core of the projectile to the area of the core passage at the leading edge is such that on firing, the flow through the hollow core of the projectile is supersonic, and when the projectile slows to a lower predetermined supersonic speed due to aerodynamic drag, the flow through the core chokes so that the projectile presents the flight configuration of a solid cylinder with a detached bow shock wave. The resultant high drag acts to curtail the flight of the projectile.

Laviolette teaches the use of a full bore, relatively high drag projectile, which is necessary to provide adequate retard to provoke choking at the desired range. The "C62" projectile designed according to Laviolette to simulate the 105 mm armour piercing discarding sabot (APDS) round has a retard of 0.35 m/s/m compared with a retard of 0.10 m/s/m for the combat round. In addition, the Laviolette full bore projectile has a very large gyroscopic stability (Sg) (see Laviolette, column 10), the C62 having an Sg of 60 while the APDS has an Sg value of 1.5. With these high values for retard and gyroscopic stability, the Laviolette projectile inevitably has a high cross wind sensitivity. As noted in Laviolette this yields a round that is not a perfect trajectory march to the APDS round, although it is a "best fit".

Applying Laviolette to the design of a projectile to simulate a low retard round such as the APFSDS, which has a retard of 0.05 m/s/m, it is found that the full bore STUP has a retard that is excessive and prevents an adequate trajectory match. It therefore becomes necessary to use a subcalibre STUP to reduce the retard and provide a better match to the APFSDS trajectory. However, the subcalibre STUP has a very much increased range, far greater than the acceptable maximum for a practice projectile of this type. The reasons for this are evident from a consideration the theoretical discussion and drawing FIG. 7 in Laviolette. For a projectile with even the theoretical minimum 0.66 area ratio, the speed of the projectile must be less than M2 in order to produce choking. With a low retard to provide a closer match to the low retard APFSDS combat projectile, this speed is not reached until the projectile is much further down range than is the case with a full bore, high retard projectile as taught by the Laviolette patent. It is therefore apparent that no adequate compromise can be made between the trajectory match and range limitation characteristics of the STUP projectile, and the concept of aerodynamic choking is prima facie not viable as a range curtailment technique in simulating a low retard combat round such as the APFSDS.

SUMMARY

The present invention provides a projectile with the desired characteristics by combining a low retard, low gyroscopic stability, subcalibre STUP with a spin retarding mechanism that acts to bring about early choking of the projectile. The physical effect of the spin retarding mechanism is to reduce the spin of the projectile more quickly than the projectile speed, thus bringing about a reduction in the gyroscopic stability of the projectile in flight. When the gyroscopic stability is reduced to below 1.0 the angle of attack of the projectile suddenly increases. This increase of angle of attack results in early choking of the flow through the projectile. The combined effect of high angle of attack and choking is a large increase of the drag and retard of the projectile, thus bringing the projectile down within a very short range.

Thus, according to the present invention, a short range practice projectile comprises a subcalibre hollow tubular body having an annular leading edge with an internal wedge adjacent the leading edge, the area ratio of the smallest open area in the hollow core to the area of the core passage at the leading edge being such as to sustain a supersonic flow within the tubular body at projectile speeds above a selected supersonic speed and to produce a choked flow within the tubular body in response to reduction of the projectile speed to a speed lower than the selected speed; spin damping means on the external surface of the tubular body for slowing the spin of the body during flight at a selected rate greater than the rate of velocity decrease, whereby the flight of the projectile becomes unstable, the angle of attack of the projectile increases and the flow within the tubular body becomes choked at a projectile speed above said selected supersonic speed; and a sabot carrying the body.

Prototype projectiles constructed according to the inventive concept have been a good trajectory match to the APFSDS round out to 2500 m. The total range of the projectile is 8000 m, at 10° gun elevation, thus meeting the desired maximum range. It has also been determined that a projectile according to the present invention has less drag in stable flight and better accuracy than an identical sub-calibre STUP without fins.

The low retard and low gyroscopic stability of the present projectile have the additional benefit of reducing the cross wind sensitivity of the projectile.

It is to be observed that this spin retarding technique is not readily applicable to a full bore STUP such as those taught by Laviolette because the gyroscopic stability of the full bore STUP is too high. With the C62 STUP, for example, the gyroscopic stability is 60 and the spin rate would have to be reduced by a factor of about 8 in order to bring this down to 1, where the projectile becomes unstable.

While the spin retarding technique is known per se as a range curtailment technique, as described in AB Bofors British patent application No. 2,091,856 and the complementary paper "A Practice Round With a Short Safety Range" T. Wik. and K. E. Pettersson, R&D Ammunition, AB Bofors, it is not used as a trigger for projectile choking. The present invention provides a significant performance improvement over spin destabilization per se. Prototype projectiles according to the invention have a 25% longer range over which a trajectory match to the simulated round is maintained (2500 m v. 2000 m) and exhibit significantly lower retard (0.13 m/s/m v. 0.20 m/s/m) than the commercial Bofors round 105-50 TPDS-T intended to simulate the 105 mm APFSDS combat round.

BRIEF DESCRIPTION OF THE DRAWINGS

In the accompanying drawings, which illustrate an exemplary embodiment of the present invention:

FIG. 3 is a cross sectional view of the projectile with dimensional legends;

FIG. 11 is a plot showing the comparison of maximum ranges of different projectiles launched at an elevation of 15°.

DETAILED DESCRIPTION

Figure 1:
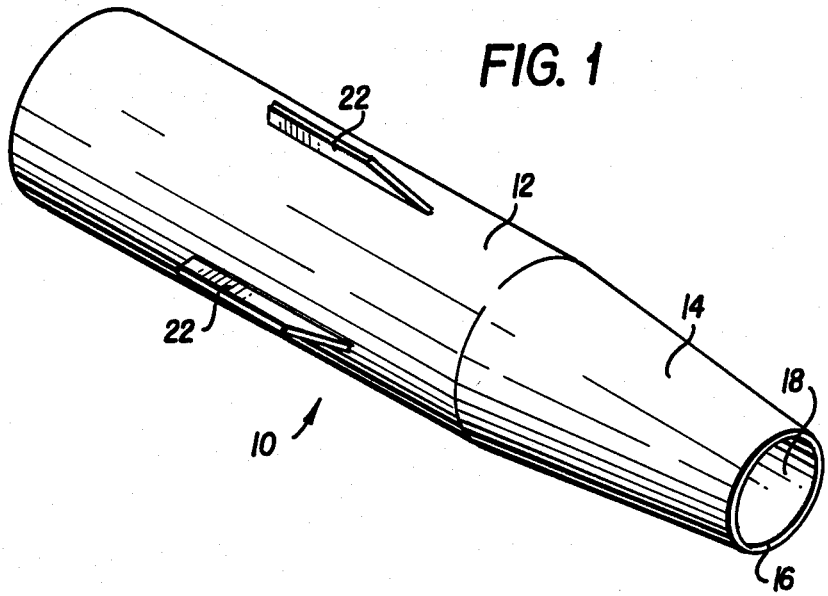
FIG. 1 is a perspective view of a projectile according to the present invention.
Figure 2:
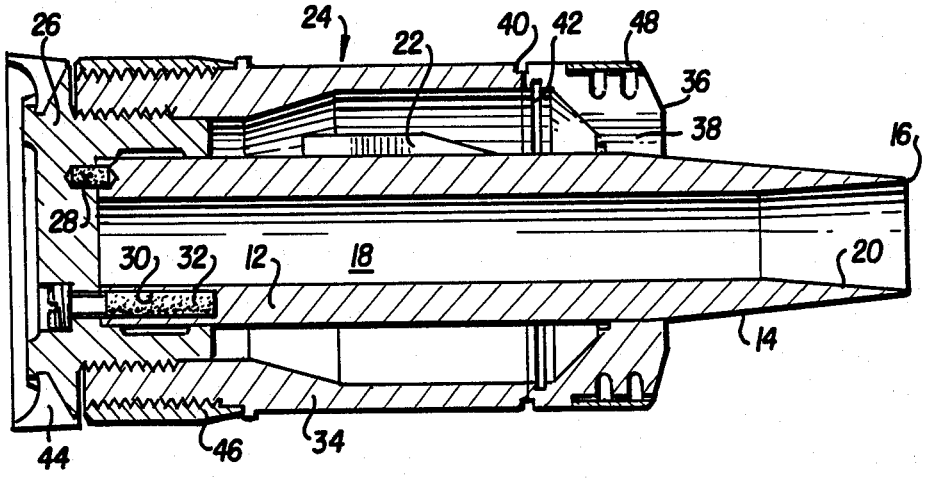
FIG. 2 is a cross sectional view of the projectile of FIG. 1 mounted in a sabot.

Referring to the accompanying drawings, FIGS. 1 and 2 illustrate a spin stabilized tubular projectile 10 intended to be fired from a 105 mm calibre gun to simulate a 105 mm armour piercing fin stabilized discarding sabot (APFSDS) round. The projectile has a hollow tubular body 12 with a leading section 14 that tapers to a sharp or slightly rounded leading edge 16. The hollow core 18 of the tubular body is configured to present an internal wedge 20 adjacent to the leading edge 16. The area ratio of the projectile, that is the ratio of the smallest open area in the hollow core (At) to the area of the core passage at the edge 16 (Ai) is selected to provide a supersonic flow on firing and subsequent choked flow when the speed of the projectile reduces to a desired critical level. This characteristic is described more fully in Laviolette U.S. Pat. No. 4,164,904 that has been referred to in the foregoing. The approximate dimensions of the projectile illustrated in FIG. 3 are:

overall length L: 217 mm
outside diameter Do: 55 mm
throat diameter Dt: 30 mm
intake diameter Di: 35 mm
outside wedge angle Oo: 6°
inside wedge angle Oi: 3°
leading edge radius: 0.25 mm The fineness ratio of the body (L:D) is about 4.

The projectile has three small radial fins 22 spaced equally about the tubular body 12 of the projectile. The fins project sufficiently from the body to interact with the surrounding air during flight to damp the spin of the projectile. In this embodiment, the fins are approximately 6 mm in radial extent and are located adjacent the center of gravity of the projectile so as not to contribute excessively to either the stabilization or destabilization of the projectile other than by spin damping.

FIG. 2 of the accompanying drawings illustrates the finned projectile mounted in a full bore sabot 24. The sabot has a base 26 to which the projectile is secured by pins 28 fitted into aligned bores in the base and the trailing end of the projectile. The trailing end of the projectile also has a bore 30 filled with a tracer material 32 for providing a visual indication of the trajectory on firing. The sabot has a main body 34 connected to the base 26 that extends forwardly over the projectile. A leading section 36 of the sabot body has a series of radial through slots 38 that end adjacent external and internal circumferential grooves 40 and 42 respectively. The radial slots and the circumferential grooves permit the break-up of the sabot body due to the aerodynamic forces exerted on it on launch of the projectile. The base 26 of the sabot carries an obturator 44 for closing the bore of the gun during firing of the projectile. A driving band 46 is fitted to the main body of the sabot just ahead of the obturator and a centering band 48 surrounds the leading end of the main body.

On launch of the projectile-sabot combination as illustrated in FIG. 2, the sabot breaks up releasing the projectile to carry on alone. This arrangement is known and will not be described further.

Figure 4:
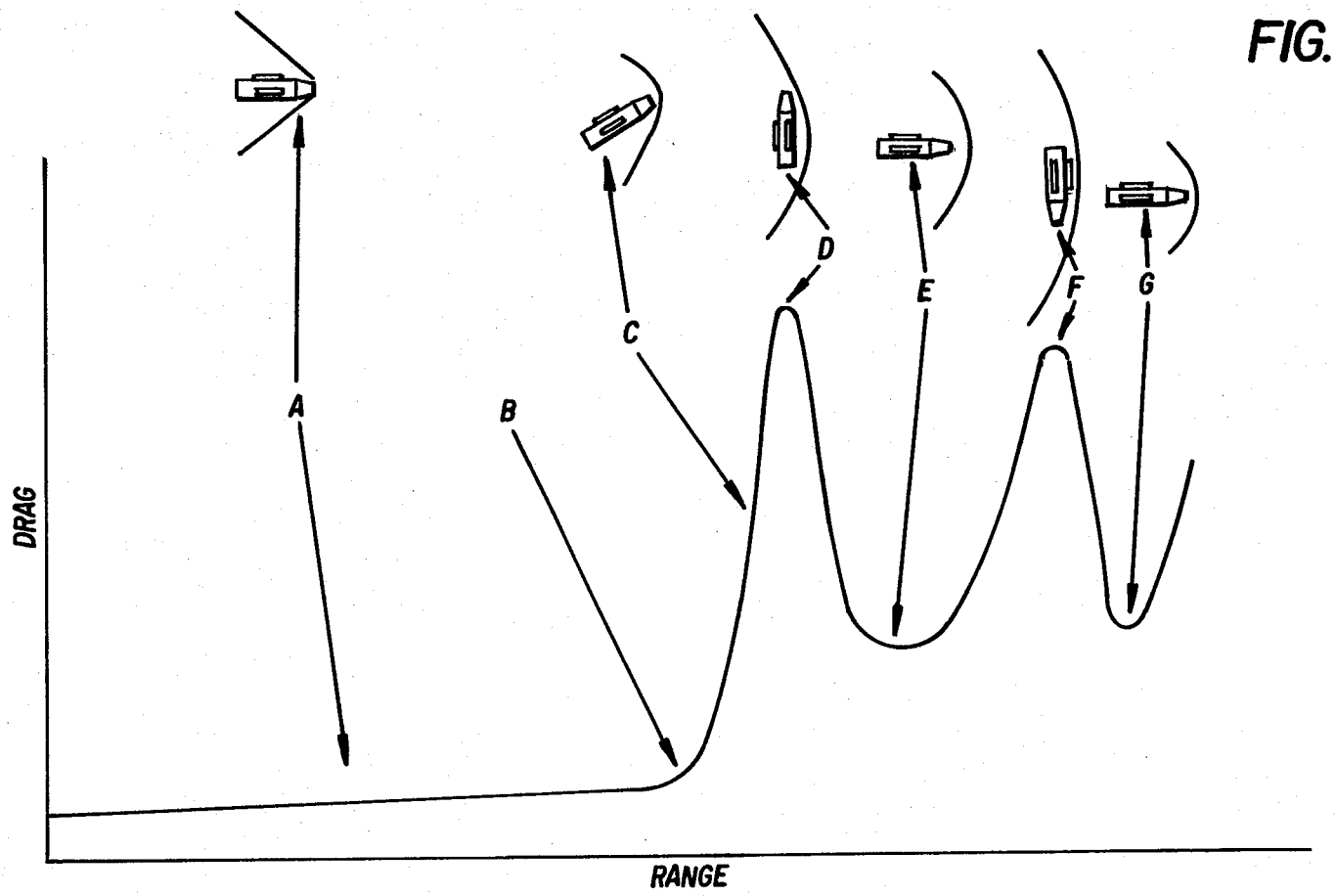
FIG. 4 illustrates the variations in drag coefficient with range of a projectile according to this invention.

After launch, the fins 22 damp the spin of the projectile and bring about early choking and high drag flight FIG. 4 illustrates how the drag of the projectile is believed to vary with range, and also illustrates pictorially the orientation of the projectile at the various stages of the flight. As shown at 'A', the projectile 10 is in stable flight, with an attached shock wave 50, and supersonic flow through the hollow core. The drag of the projectile is low, and relatively constant. As the projectile proceeds down range, the fins 22 slow its spin at a rate greater than the rate at which the velocity decreases Because the gyroscopic stability (Sg) is proportional to the square of the ratio of spin rate (p) to velocity (V) ($Sg\alpha\ (P/V)^2$) the gyroscopic stability of the projectile decreases. When Sg reduces to less than 1.0, this brings about an increased angle of attack, which in turn brings on early choking of the flow through the projectile and development of a detached bow wave 52, as indicated at 'B'. The angle of attack continues to increase as shown at 'C', to a maximum at 'D' when the projectile is perpendicular to the direction of flight. The high drag causes rapid deceleration and the projectile velocity may be reduced faster than the spin decay. If this occurs, the gyroscopic stability may increase above 1, and the projectile flight would restabilize as shown at 'E'. The flow through the projectile core remains choked, however, so that a low drag flight regime is not achieved. Continued reduction in the spin rate brings on instability once more, and the projectile continues to oscillate, as shown at 'F' and 'G'.

Figure 5:
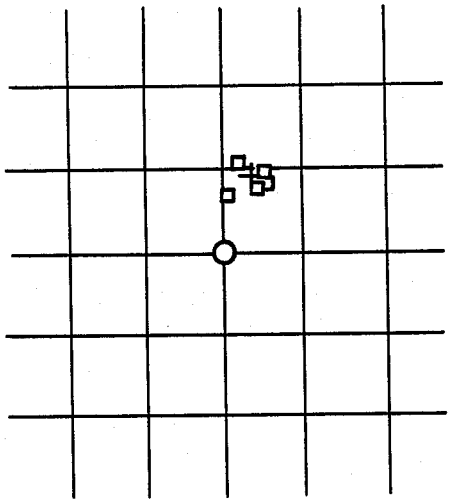
FIGS. 5, 6 and 7 are plots showing the accuracy of firings at 1000 m. range of three different projectiles, one of which is constructed according to the present invention.
Figure 6:
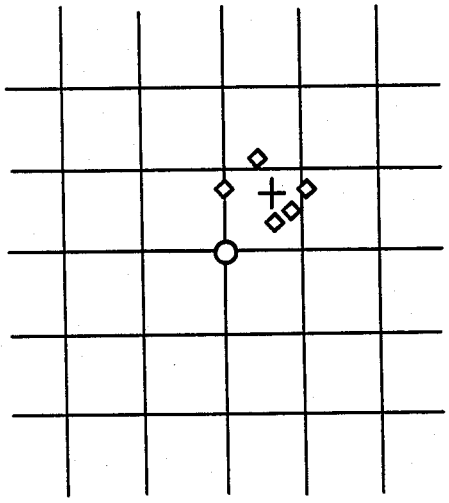
Figure 7:
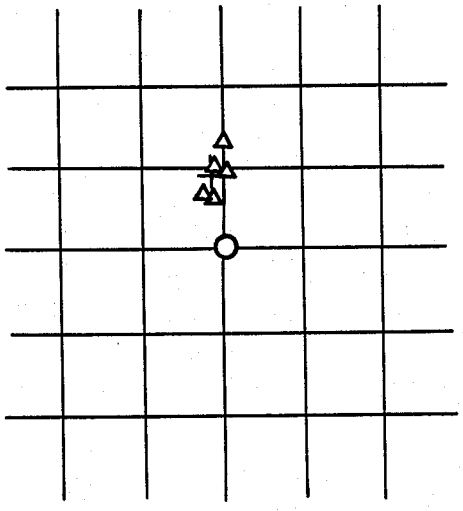
Figure 8:
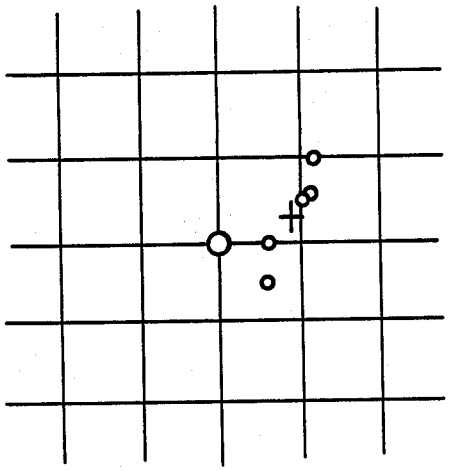
FIGS. 8, 9 and 10 are Figures like FIGS. 4, 5 and 6 respectively, displaying accuracy of firings at 2500 m. range.
Figure 9:
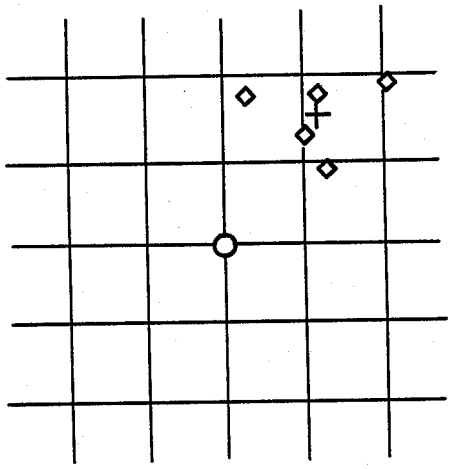
Figure 10:
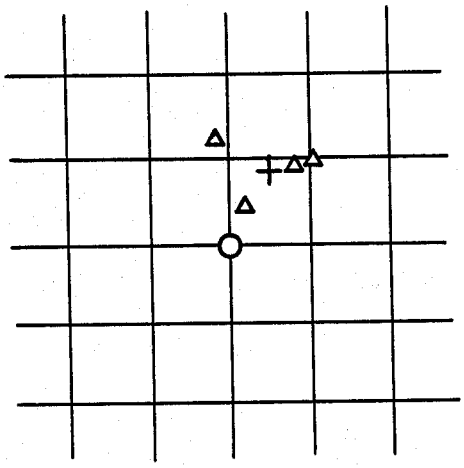

FIGS. 5 through 7 illustrate the accuracy of firings at a 1000 m range of conventional training projectiles with a discarding sabot (TPDS) (FIG. 5), STUP projectiles identified as "Model 59" (FIG. 6), and projectiles according to the invention identical to the STUP Model 59 but with spin damping fins (FIG. 7). The circle at the center of each chart indicates the aim point, the small cross indicates the mean point of intersection of the projectiles with the measuring plane and the other markings, circles, squares or triangles, show the points of intersection of the individual projectiles. FIGS. 8, 9 and 10 are like FIGS. 5, 6 and 7, but illustrate the accuracy at 2500 meters range. As will be apparent the projectile of the present invention is more accurate than the STUP Model 59 without fins and roughly comparable in accuracy to the conventional training projectile.

FIG. 11 illustrates the comparative maximum ranges of various projectiles when fired under the same conditions. Curve A represents the trajectory of the armour piercing fin stabilized, discarding sabot (APFSDS) round that is to be simulated. Curve B represents the trajectory of the training projectile, discarding sabot C-74(TPDS C-74) that is referred in FIGS. 5 and 8. Curve C designates the trajectory of a STUP C62 which is a full bore and unfinned. Curve D is the trajectory of a STUP Model 59. Curve E is the trajectory of a projectile according to the invention, identical to the STUP Model 59, with fins.

As will be apparent from FIG. 11, the trajectory of each projectile is a good match to the trajectory of the simulated APFSDS for the initial part of the projectile's flight. The projectile of the invention however, comes down at about 8 kilometers rather than 30 kilometers for the actual round, 15 kilometers for the STUP Model 59, 14.4 kilometers for the TPDS and 7.2 kilometers for the STUP C-62.

While one embodiment of the invention has been described in the foregoing, it is to be understood that other embodiments are possible. For example, surface formations on the STUP other than fins may be found to damp the spin of the projectile adequately. The formations must only interact wirh the air layer around the projectile sufficiently to damp the spin at the desired rate. Some tests have indicated that grooves in the surface of a STUP do not produce enough skin friction to damp the spin in an effective way and thus are not spin damping formations for the purposes of the present invention.

We claim:

1. A short range practice projectile comprising a subcaliber hollow core tubular body having an annular leading edge with an internal wedge adjacent the leading edge, the area ratio of the smallest open area in the hollow core to the area of the core passage at the leading edge being such as to sustain a supersonic flow within the tubular body at projectile speeds above a selected supersonic speed and to produce a choked flow within the tubular body in response to reduction of the projectile speed to a speed lower than the selected speed; spin damping means comprising a plurality of fins on the external surface of the tubular body for slowing the spin of the body during flight at a selected rate greater than the rate of velocity decrease, whereby the flight of the projectile becomes unstable, the angle of attack of the projectile increases, and the flow within the tubular body becomes choked at a projectile speed above said selected supersonic speed; and a sabot carrying the body.

2. A projectile according to claim 1 including three fins spaced equally around the projectile.

3. A projectile according to claim 2 wherein the fins are located adjacent the projectile's center of gravity.

4. A projectile according to claim 1, wherein the tubular body has a fineness ratio of substantially 4.

5. A projectile according to claim 1, including a bore in a trailing end of the projectile and a tracer material accommodated in the bore.

6. A method of controlling the range of a practice projectile having a hollow, tubular configuration and an internal wedge at the leading end of the projectile, comprising: firing the projectile from a gun at a supersonic speed sufficient to cause supersonic flow through the projectile, and with sufficient spin to be gyroscopically stable; slowing the spin of the projectile, whereby the gyroscopic stability of the projectile is reduced and the angle of the attack of the projectile is increased thus causing the flow through the projectile to choke in response to the increasing angle of attack.

* * * * *